US010337253B2

(12) United States Patent
Leuenberger

(10) Patent No.: US 10,337,253 B2
(45) Date of Patent: Jul. 2, 2019

(54) DRILL HEAD FOR A DRILLING DEVICE FOR CREATING DRILL HOLES IN INSUFFICIENTLY STABLE FOUNDATION

(71) Applicant: Marti Gründungstechnik AG, Moosseedorf (CH)

(72) Inventor: Daniel Leuenberger, Zimmerwald (CH)

(73) Assignee: MARTI GRÜNDUNGSTECHNIK AG, Moosseedorf (CH)

( * ) Notice: Subject to any disclaimer, the term of this patent is extended or adjusted under 35 U.S.C. 154(b) by 128 days.

(21) Appl. No.: 15/630,306

(22) Filed: Jun. 22, 2017

(65) Prior Publication Data

US 2018/0371842 A1 Dec. 27, 2018

(51) Int. Cl.

| | |
|---|---|
| ***E21B 10/44*** | (2006.01) |
| ***E02D 7/00*** | (2006.01) |
| *E02D 5/38* | (2006.01) |

(52) U.S. Cl.

CPC ..... *E21B 10/44* (2013.01); *E02D 7/00* (2013.01); *E02D 5/38* (2013.01); *E02D 2250/00* (2013.01)

(58) Field of Classification Search

CPC ..... E21B 10/44; E02D 7/00; E02D 2250/00; E02D 5/38

See application file for complete search history.

(56) References Cited

U.S. PATENT DOCUMENTS 3,094,178 A * 6/1963 Newbold ..... E21B 10/44 175/388

FOREIGN PATENT DOCUMENTS

| | | | |
|---|---|---|---|
| DE | 8908131 | U1 | 10/1990 |
| DE | 19734068 | A1 | 2/1999 |
| EP | 1580397 | A1 | 9/2005 |
| EP | 1860274 | A1 | 11/2007 |
| EP | 2146046 | A1 | 1/2010 |

* cited by examiner

*Primary Examiner* — Brad Harcourt

(74) *Attorney, Agent, or Firm* — Pearne & Gordon LLP

(57) ABSTRACT

A drill head for a drilling device for making drill holes in insufficiently stable foundation by displacement of soil material has a base plate, with which the drill pipe end is detachably connected and is closable, on which base plate at least one drill head plate, oriented substantially perpendicular thereto, is placeable. Insertable in the lateral flanks is at least one curved plate, which is provided with first holding means, which are held in second holding means, which are attached on the lateral flanks of the drill head plate. The curved plate is designed in a way and is insertable in the flanks of the drill head plate such that its surfaces are effective as screw faces during the drilling process. The efficiency of the drilling can thereby be improved.

9 Claims, 7 Drawing Sheets

DRILL HEAD FOR A DRILLING DEVICE FOR CREATING DRILL HOLES IN INSUFFICIENTLY STABLE FOUNDATION

This invention relates to a drill head for making drill holes in insufficiently stable foundation by displacement of soil material, which drill head is placeable on a drill pipe of the drilling device and forms with the drill pipe a releasable connection secured against rotation, and the drill head has a base plate, with which the drill pipe end is closable, on which base plate at least one drill head plate, oriented substantially perpendicular thereto, is placeable.

When the foundation in-situ at the foundation depth of a building project turns out to be insufficiently stable for supporting loads or causes intolerable sinking for the structure, pilings are used, for example, as foundation for this structure. They transfer the building loads to the lower-lying soil layers capable of load bearing.

To produce a displacement bore pile of this kind, a drill pipe is provided at the lower end with a drill head. The drill head and the drill pipe are connected together in a way secured against rotation. By means of a drilling device, this drill pipe is screwed into the ground, under high vertical pressure, to the required depth. The soil material is thereby displaced by the volume of the drill pipe. When the final depth is reached, a prefabricated pile reinforcement is introduced into the drill pipe and the pipe is filled with concrete. The drill pipe is thereby pulled back under constant rotation. The drill head detaches itself from the drill pipe and remains in the foundation. During the withdrawal, the concrete located in the drill pipe flows out and thus fills to the required level the thus created hollow space in the earth after successful withdrawal of the drill pipe. One thereby obtains, after the hardening of the concrete, the reinforced displacement bore pile capable of bearing loads.

Drill heads of this kind are known in diverse designs. The publication EP A 2 146 046 shows a drill head having a base plate, on which drill head plates, oriented perpendicular thereto, are put, which drill head forms, via protrusions that project into corresponding recesses in the drill pipe end, a detachable connection with the drill pipe, secured against rotation. With this drill head, which can be produced very simply and inexpensively, the drill holes can be made simply and cost-effectively.

The object of the present invention now consists in designing the drill head such that, besides the simple and cost-effective production and the possibility of a space-saving storage and transport, a more efficient making of a drill hole can be achieved.

This object is achieved according to the invention in that insertable in the lateral flanks of this drill head plate is at least one curved plate, which is provided with first holding means, which are held in second holding means, which are attached on the lateral flanks of the drill head plate, and in that the curved plate is designed in a way and is insertable in the flanks of the drill head plate such that its surfaces are effective as screw faces during the drilling process.

Achieved with this design according to the invention of the drill head is that the curved plate, effective as screw faces, of the drill head, set in rotation by the drilling device, can penetrate more quickly and more efficiently into the earth. In particular, the time spent for making a drill hole becomes shorter.

Preferably insertable in the lateral flanks of the drill head plate is a first curved plate and a second curved plate, opposite the first curved plate. Through the symmetrical arrangement of these two curved plates, the efficiency of the drill head is improved.

Preferably placeable on the base plate is a first drill head plate and a second drill head plate, aligned substantially perpendicular thereto, which are provided with slot-shaped recesses in such a way that the two drill head plates are able to be plugged into one another in a crosswise way, whereby a simple and stable construction of the drill head is achieved.

A simpler structure for the drill head is achieved in that the first curved plate and the opposite-situated second curved plate each extend beyond a flank of the first drill head plate and an adjacent flank of the second drill head plate.

Preferably the regions of the first drill head plate and of the second drill head plate remote from the base plate are designed in a tapering way, and insertable in the tapering regions of the first drill head plate and of the second drill head plate is a third curved plate, which additionally improves the efficiency of the drilling process.

Preferably the third curved plate extends beyond a flank of the first drill head plate, the other flank of the second drill head plate and the other flank of the first drill head plate. The stability of the drill head is thereby improved.

Another advantageous embodiment of the invention consists in that the first holding means and the second holding means are composed of slot-shaped recesses and/or projections made in the respective curved plates or respectively drill head plates. A good stability also results, in addition to the simple design of these connections and the simple composition of the drill head.

Preferably the first drill head plate and/or the second drill head plate is or are provided with protrusions, which protrusions project through corresponding openings provided on the base plate, and the protrusions protrude beyond the base plate on the drill pipe side and project into slots correspondingly provided on the drill pipe end. Thereby achieved is a simple and optimal connection of the drill head to the drill pipe. To obtain a simpler composition and optimal stability of the drill head, the protrusions are held in the base plate via fixing means.

The drill head plates and the curved plates are able to be produced by cutting out of a commercially available steel plate, whereby the costs can be kept low.

Embodiments of the device according to the invention will be explained more closely in the following, by way of example, with reference to the attached drawings.

FIG. 1 shows a side view of a first embodiment of the drill head according to the invention;

FIGS. 2 to 4 each show a three-dimensional representation of the drill head according to the invention according to FIG. 1, in different rotational positions;

Figure 6:
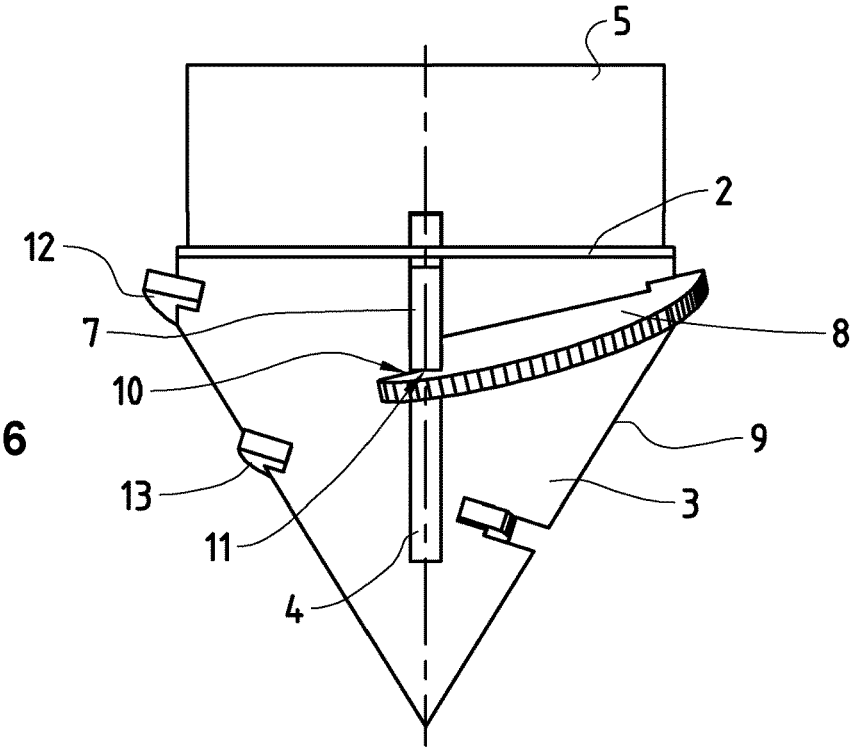
FIG. 6 shows a side view of another embodiment of the drill head according to the invention.
Figure 7:
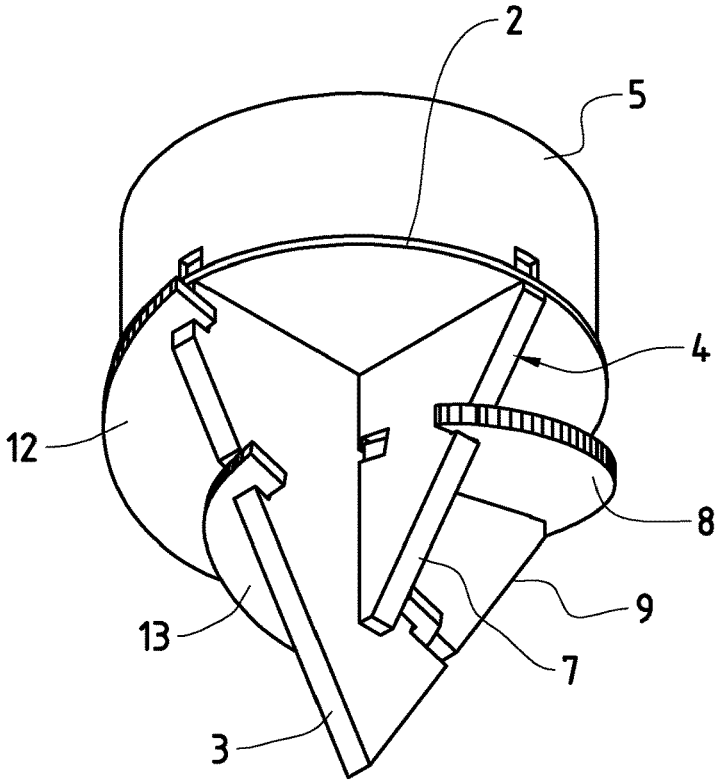
Figure 8:
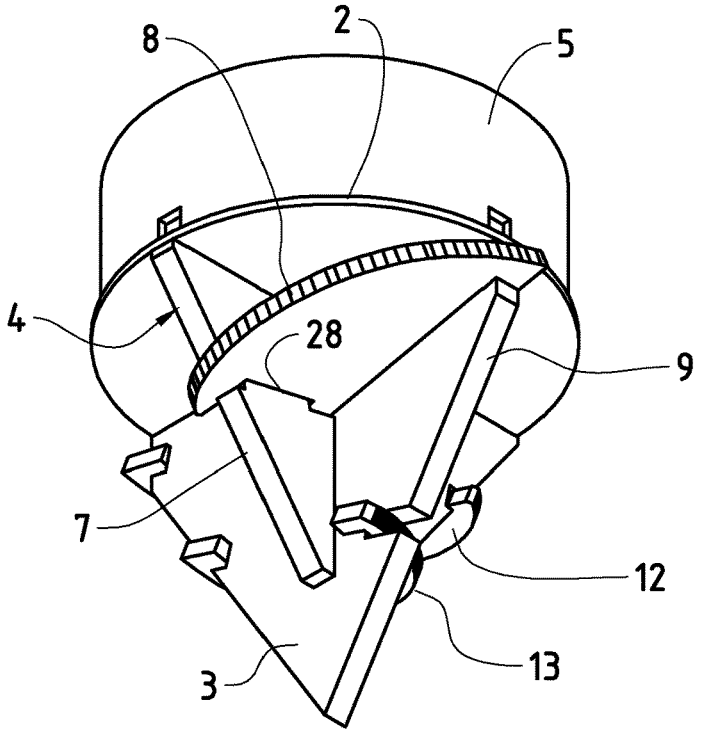
Figure 9:
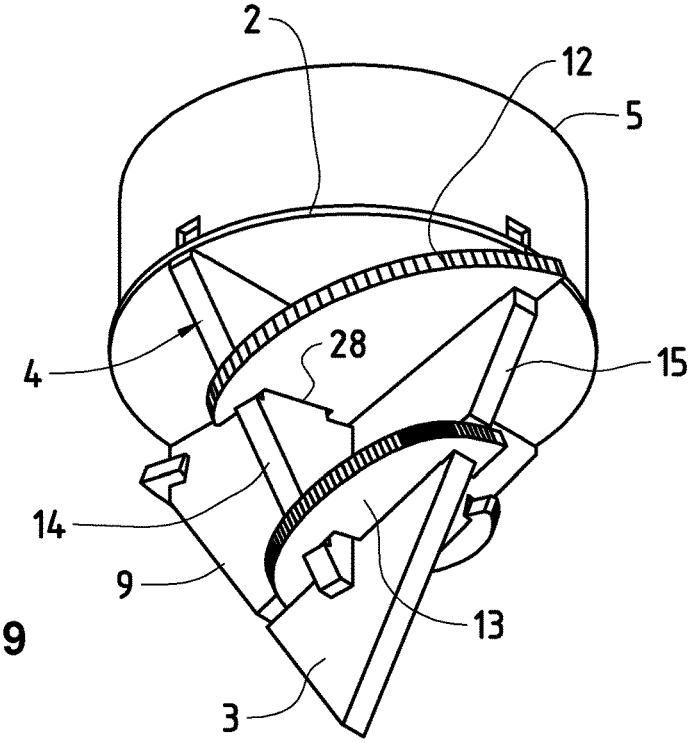
Figure 10:
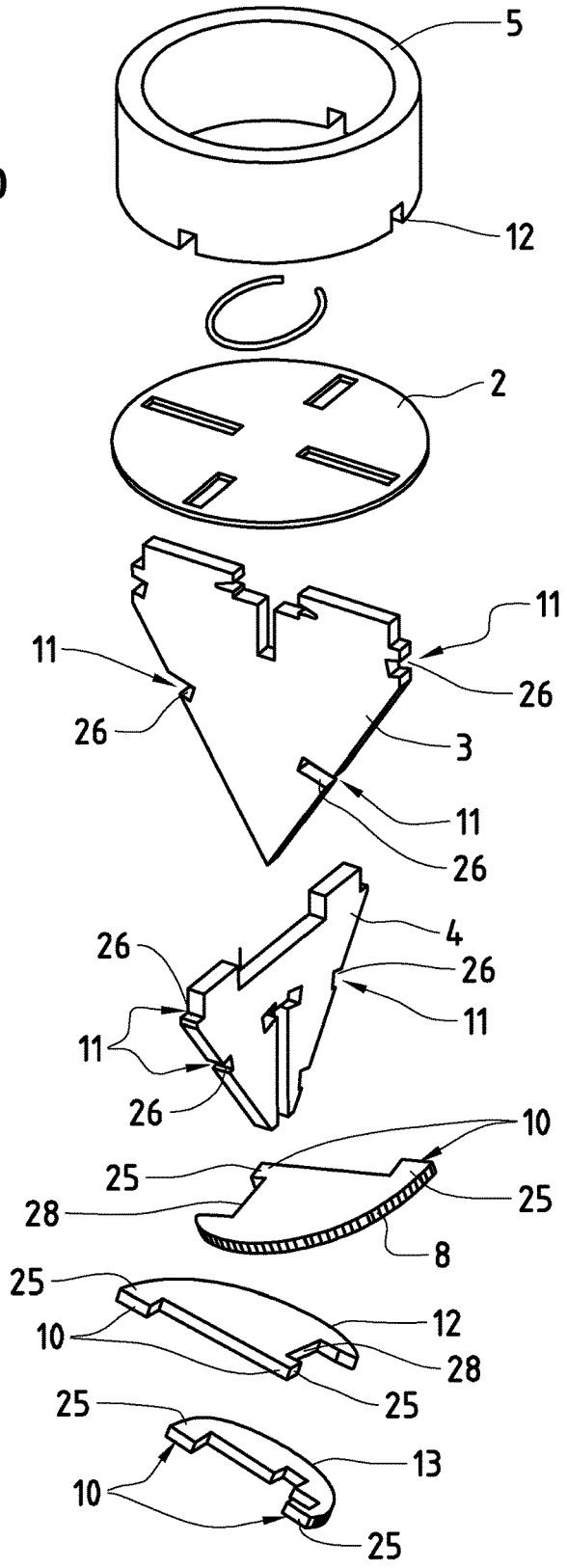
Figure 11:
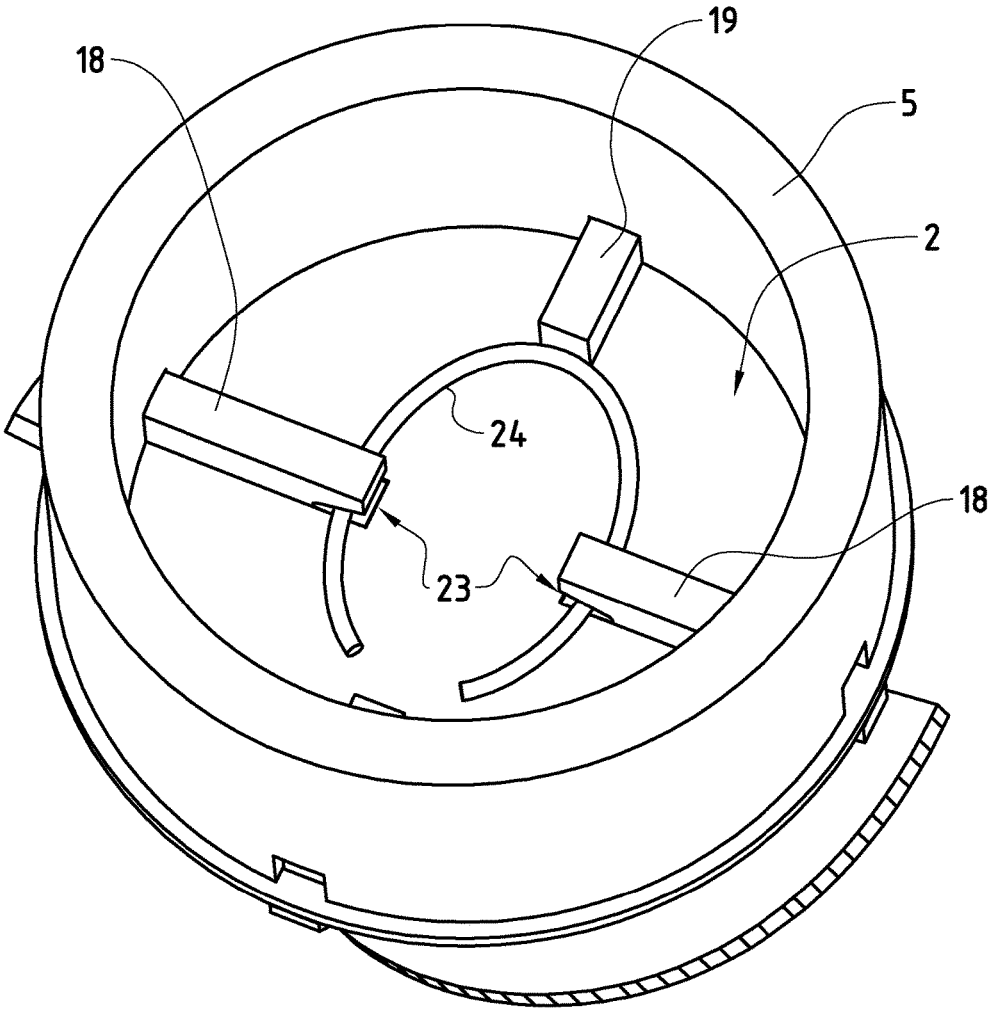

FIGS. 7 to 9 each show in a three-dimensional representation the drill head according to the invention according to FIG. 6 in different rotational positions;

FIG. 10 shows in a three-dimensional and pulled-apart representation the components of the drill head according to FIG. 6 with the drill pipe end; and FIG. 11 shows in a three-dimensional representation a view from above of a drill head according to the invention.

Figure 1:
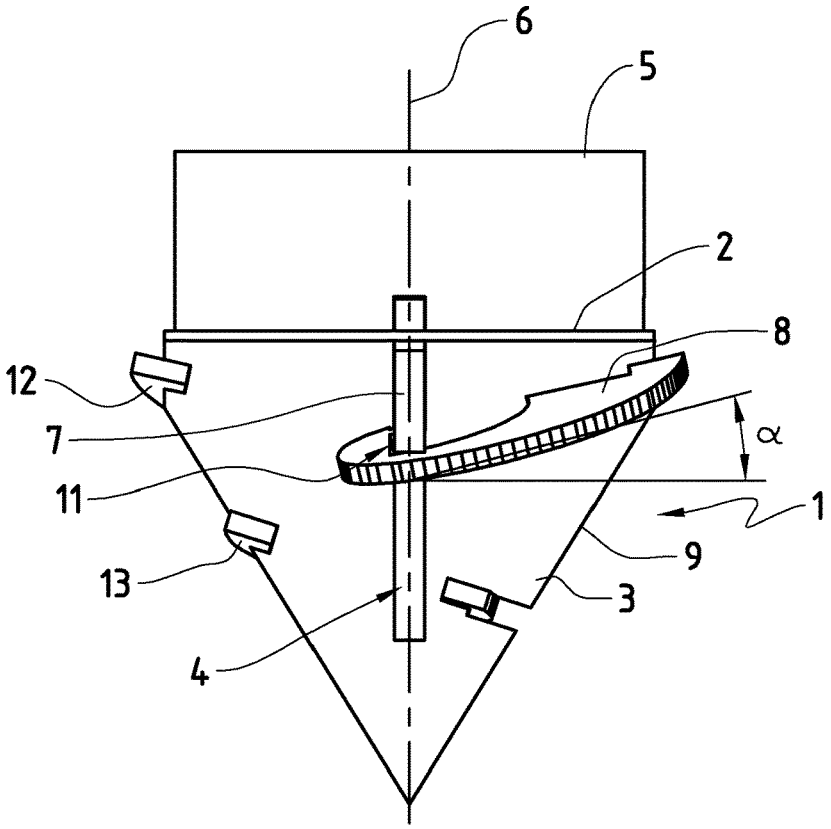

Seen from FIG. 1 is a first embodiment of a drill head 1 according to the invention, which has a base plate 2, on which a first drill head plate 3 and a second drill head plate 4 are put. Of course, instead of two drill head plates, just one drill head plates or e.g. three drill head plates could also be used. The first drill head plate 3 and the second drill head plate 4 are aligned perpendicular with respect to the base plate 2. Moreover these two drill head plates 3 and 4, which are pushed into one another, as will be described later, are at right angles to one another. The first drill head plate 3 and the second drill head plate 4 are each designed tapering in the regions remote from the base plate 2. The base plate 2 and the first drill head plate 3 and the second drill head plate 4 are detachably connected to an end region of a drill pipe 5, which will likewise be described later. This drill pipe 5 is driven in a known way rotating about a drill axis 6 by a drilling device (not shown) and is pressed into the foundation for drilling.

Inserted in a lateral flank 7 of the second drill head plate 4 is the front region of a first curved plate 8, whose other end region is inserted in the one lateral flank 9 of the first drill head plate 3. For this purpose this first curved plate 8 has first holding means 10, which are held in second holding means 11, which are provided on the drill head plates 3 and 4, as will be described later. This first curved plate 8 is inserted in the one lateral flank 7 of the second drill head plate 4 and in the one lateral flank 9 of the first drill head plate 3 in such a way that it is effective as screw faces. For this purpose this first curved plate 8 has, with respect to the drill axis 6 a lead angle or pitch angle $\alpha$, which is about 20 degrees in the embodiment example shown here. This angle of inclination can of course be selected in such a way that the efficiency of the drilling process in the respective corresponding foundation is the most optimal, which can be determined through trials, for example. This first curved plate 8 is designed in such a way that the radial spacing of the outer edge of this first curved plate 8 from the drill axis 6 increases from one region, which is held in the second drill head plate 4, to the other region, which is held in the first drill head plate 3.

Correspondingly inserted in the first drill head plate 3 and the second drill head plate 4, in a symmetrical way to this first curved plate 8, is a second curved plate 12, which is constructed in the same way as the first curved plate 8. Furthermore inserted in the tapering region of the first drill head plate 3 and the second drill head plate 4 is a third curved plate 13, which will be explained later. Of course it would also be conceivable to provide fewer than three or more than three curved plates, depending upon what height the drill head has.

Figure 2:
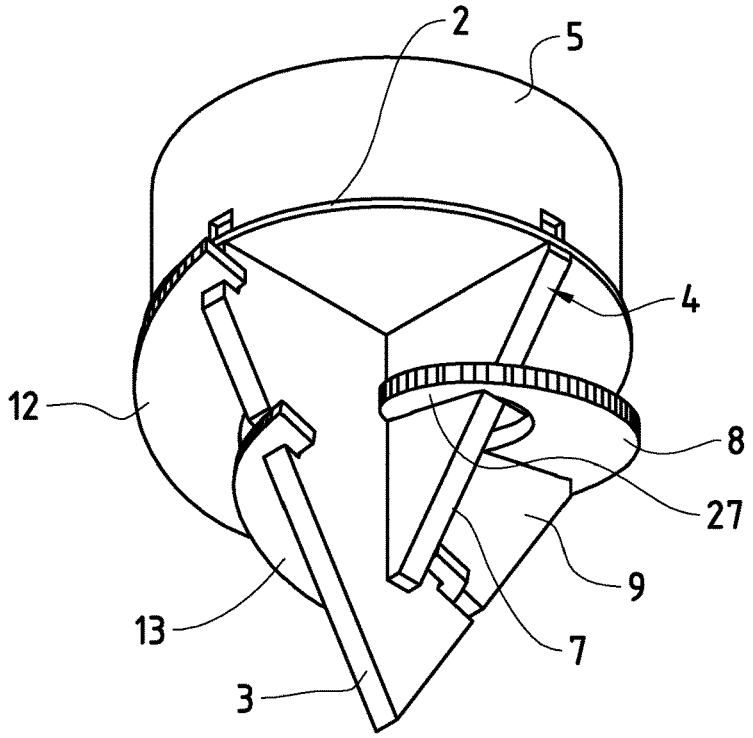
Figure 3:
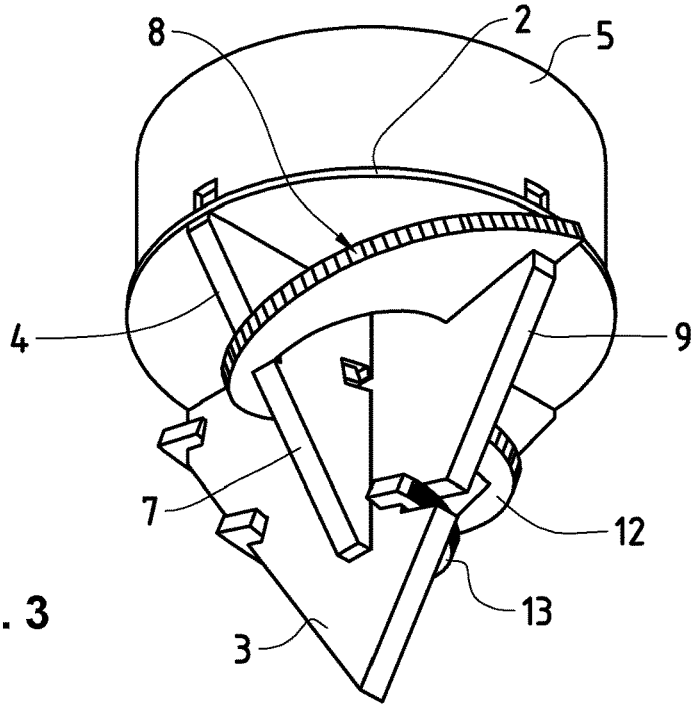
Figure 4:
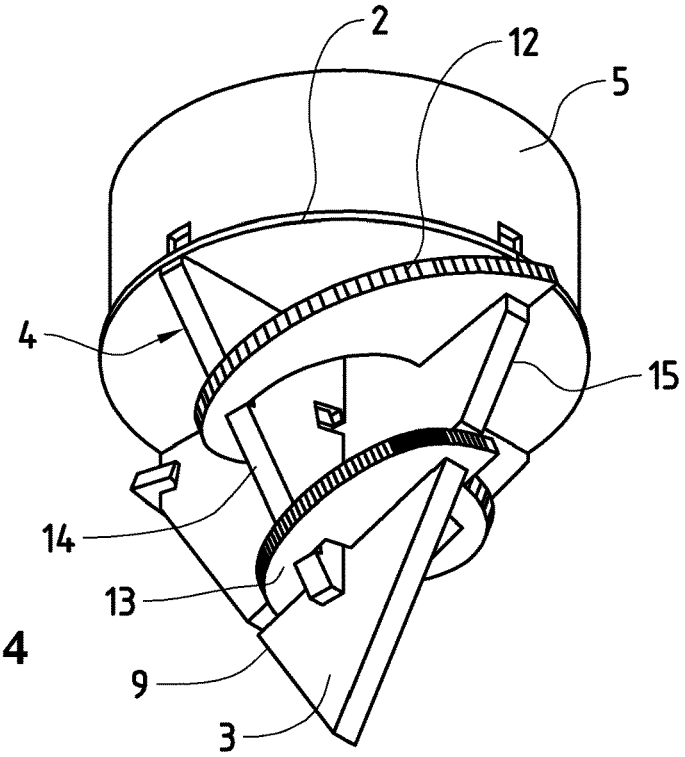

Seen from FIGS. 2 to 4 is the configuration of the first curved plate 8, the second curved plate 12 and the third curved plate 13 in the two drill head plates 3 and 4. Seen from FIG. 2 is in particular how the first curved plate 8 extends beyond the one lateral flank 7 of the second drill head plate 4 and the one lateral flank 9 of the first drill head plate 3.

FIG. 4 shows in particular how the second curved plate 12 extends beyond the other lateral flank 14 of the second drill head plate 4 and the other lateral flank 15 of the first drill head plate 3. Likewise visible is how the third curved plate 13 extends beyond the one lateral flank 9 of the first drill head plate 3, the other lateral flank 14 of the second drill head plate 4 and the other lateral flank 15 of the first drill head plate 3.

Figure 5:
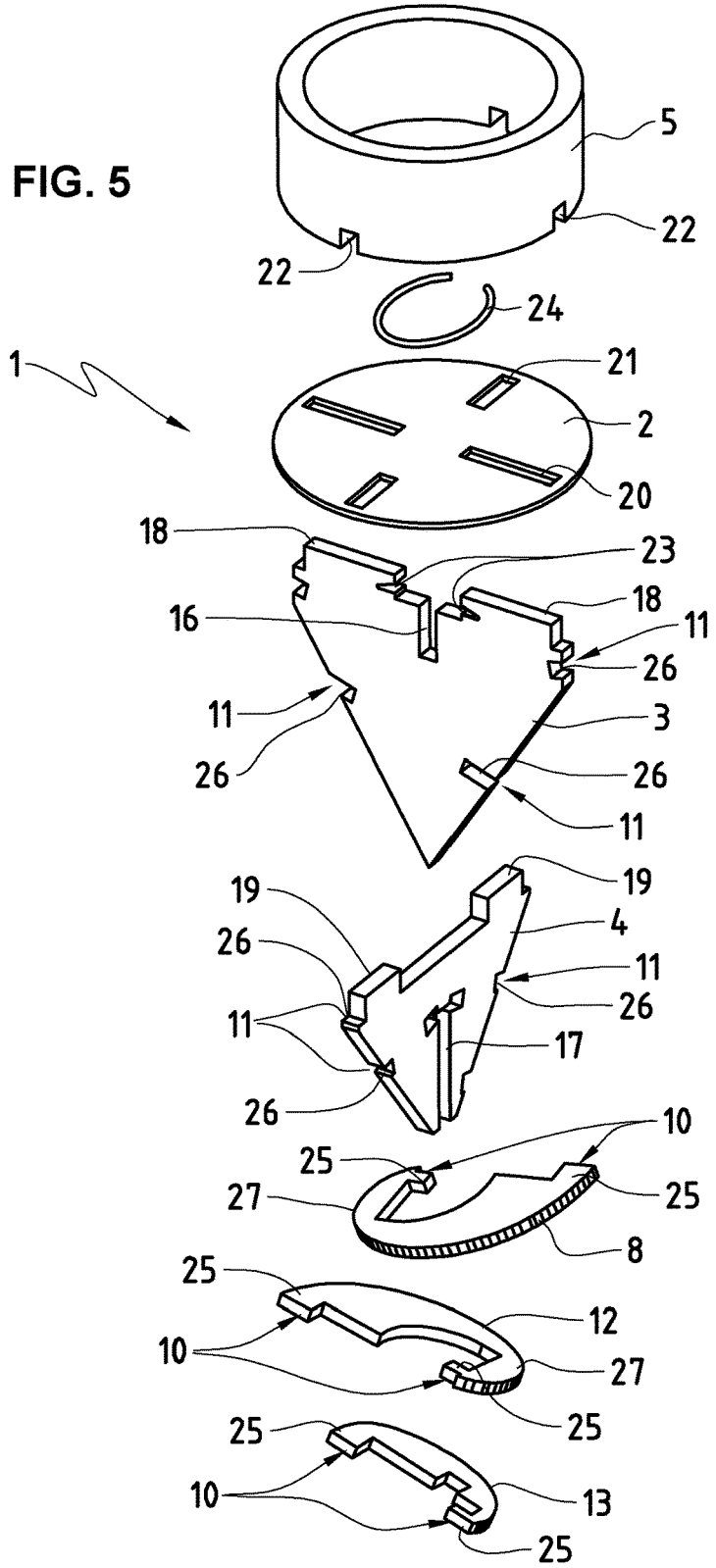
FIG. 5 shows in a three-dimensional and pulled-apart representation the components of the drill head according to FIG. 1 with the drill pipe end.

Shown in FIG. 5 are the components of the first embodiment of a drill head shown in FIGS. 1 to 4. The first drill head plate 3 and the second drill head plate 4 each have a slot-shaped recess 16 and 17, designed in such a way that they can be plugged into one another, as can be seen from FIGS. 1 to 4. The first drill head plate 3 and the second drill head plate 4 have on the regions facing the base plate 2 two protrusions each 18 or respectively 19. These protrusions 18 or respectively 19 can be inserted into corresponding slots 20 or respectively 21 made in the base plate 2. The protrusions 18 and 19 thereby protrude beyond the base plate 2. Corresponding recesses 22, which are provided at the end of the drill pipe 5, can be plugged onto the regions of the protrusions 18 or respectively 19 protruding beyond the base plate 2. In this way the desired detachable connection is obtained between the end region of the drill pipe 5 and the drill head 1. Made in the protrusions 18 of the first drill head plate 3 are, on the inside, indentations 23, in which a clamp 24 can be inserted when the first drill head plate 3 and the second drill head plate 4 are inserted in the base plate 2, so that the base plate 2 is firmly connected to the two drill head plates 3 and 4.

The first curved plate 8, the second curved plate 12 and the third curved plate 13 are provided with first holding means 10. These first holding means 10 are designed as projections 25. The first drill head plate 3 and the second drill head plate 4 are correspondingly provided with second holding means 11. These second holding means 11 are designed in particular as slot-shaped recesses 26. The first curved plate 8, the second curved plate 12 and the third curved plate 13 with their first holding means 10 can thereby be correspondingly hung in the second holding means of the two drill head plates 3 and 4. In this embodiment example, the first curved plate 8 and the second curved plate 12 have a nose 27, which clasps around the second drill head plate 4, which can be seen in particular in FIG. 2. Thereby achieved is an optimal holding of this first curved plate 8 and this second curved plate 12 in the drill head 1.

Shown in FIGS. 6 to 9 is a second embodiment of a drill head 1 according to the invention. The structure of this drill head 1 is substantially the same as the structure of the drill head as it is shown in FIGS. 1 to 5. Thus the same reference numerals are used for the same parts. The description with respect to FIGS. 1 to 4 applies correspondingly to FIGS. 6 to 9, so that a repeated description here is dispensed with. The difference between the first embodiment, shown in FIGS. 1 to 5, and the second embodiment, shown in FIGS. 6 to 10, can be seen in FIG. 10. The first curved plate 8 and the second curved plate 12 have no nose 27, as the two curved plates 8 and 12 in the first embodiment example have, as can be seen in FIG. 5. Instead in the second embodiment the first curved plate 8 and the second curved plate 12 have each been provided with a shoulder 28. As can be seen in particular in FIGS. 8 and 9, this shoulder 28 supports the second drill head plate 4 in such a way that the latter cannot be bent during the drilling procedure. An optimal stability of the drill head 1 is thereby achieved.

FIG. 11 shows the base plate 2 of the drill head 1, which is penetrated by the protrusions 18 and 19 of the first drill head plate 3 and of the second drill head plate 4. The two protrusions 18 have indentations 23, in which the clamp 24 can be inserted, so that the drill head 1 is held together, as has already been mentioned. The corresponding end of the drill pipe 5 can engage on the protrusions 18 and 19, as likewise has already been mentioned.

Achieved with the embodiment of the invention presented here is that the drill head can penetrate very efficiently into the earth to be drilled. With the pluggable design of the components of this drill head, this drill head can be brought in very compact form to the construction site, since the components are each designed plate-shaped. The assembly of the drill head takes place at the construction site, whereby little space is required for transport and storage. Of course it would also be conceivable to weld together the plate-shaped components beforehand. The individual plate elements can be cut out of a steel plate in the easiest way, for example by a controlled laser cutting device, so that these plate shapes can be produced in a simple and cost-effective manner.

The invention claimed is:

1. A drill head for a drilling device for making drill holes in insufficiently stable foundation by displacement of soil material, said drill head being placeable on a drill pipe of the drilling device and adapted to form with the drill pipe a releasable connection secured against rotation, the drill head comprising a base plate with which an end of the drill pipe is closable, on which base plate at least one drill head plate oriented substantially perpendicular thereto is placeable, said at least one drill head plate comprising a first drill head plate and a second drill head plate, aligned substantially perpendicular to the first drill head plate, a first curved plate and a second curved plate that each extend beyond a flank of the first drill head plate and an adjacent flank of the second drill head plate, said curved plates comprising first holding means adapted to be held in second holding means provided on lateral flanks of the at least one drill head plate, said curved plates being insertable in the flanks of the at least one drill head plate such that surfaces of said at least one curved plate are effective as screw faces during drilling.

2. The drill head according to claim 1, which first and second drill head plates are provided with slot-shaped recesses in such a way that the first and second drill head plates are able to be plugged into one another in a crosswise way.

3. The drill head according to claim 2, wherein regions of the first drill head plate and of the second drill head plate remote from the base plate are tapered.

4. The drill head according to claim 3, wherein insertable in the tapered regions of the first drill head plate and of the second drill head plate is a third curved plate.

5. The drill head according to claim 4, wherein the third curved plate extends beyond first and second flanks of the first drill head plate and a first flank of the second drill head plate.

6. The drill head according to one of the claim 2, wherein the first drill head plate and/or the second drill head plate is or are provided with protrusions, which protrusions project through corresponding openings provided on the base plate, and the protrusions protrude beyond the base plate on a drill pipe side thereof in order to project into slots correspondingly provided on the drill pipe end.

7. The drill head according to claim 6, wherein the protrusions are held in the base plate via fixing means.

8. The drill head according to one of the claim 1, wherein the first holding means and the second holding means are composed of slot-shaped recesses and/or projections made in the respective curved plates and/or drill head plates.

9. The drill head according to one of the claim 1, wherein the drill head plates and the curved plates are able to be produced by cutting out of a steel plate.

* * * * *